US006122922A

United States Patent [19]

Conner

[11] Patent Number: 6,122,922

[45] **Date of Patent: *Sep. 26, 2000**

[54] METHOD AND APPARATUS FOR COOLING AIR AND WATER

[76] Inventor: Leo B. Conner, 2444 N. 39th Pl., Phoenix, Ariz. 85008

[ * ] Notice: This patent is subject to a terminal disclaimer.

[21] Appl. No.: 09/227,425

[22] Filed: Jan. 8, 1999

Related U.S. Application Data

[60] Continuation-in-part of application No. 09/064,405, Apr. 22, 1998, which is a division of application No. 08/924,727, Sep. 5, 1997, Pat. No. 5,778,696.

[51] Int. Cl.[7] ..... F25D 17/06

[52] U.S. Cl. ..... 62/91; 62/305; 62/183

[58] Field of Search ..... 62/305, 91, 185

[56] References Cited

U.S. PATENT DOCUMENTS

| | | | |
|---|---|---|---|
| 4,248,057 | 2/1981 | Yaguchi | 62/183 |
| 4,836,239 | 6/1989 | Kinkead | 62/305 |
| 5,383,337 | 1/1995 | Baker | 62/121 |
| 5,409,616 | 4/1995 | Garbutt et al. | 210/760 |
| 5,682,757 | 11/1997 | Peterson | 62/305 |
| 5,778,696 | 7/1998 | Conner | 62/238.6 |
| 5,911,745 | 6/1999 | Conner | 62/91 |

*Primary Examiner*—William Doerrler
*Assistant Examiner*—Mark Shulman
*Attorney, Agent, or Firm*—Schmeiser, Olsen & Watts; Jared S. Goff

[57] ABSTRACT

The present invention provides a method and apparatus for efficiently using various components as a system for cooling air. The apparatus uses the combination of an evaporative cooler with a water reservoir and a refrigerated air system with a water-cooled condenser. A pump or series of pumps are used to supply water to the evaporative cooler and to the water-cooled condenser from the water reservoir. A mechanism for controlling the hardness of supplied water may also be included. After the reservoir water has been supplied to the other components in the system, it is returned to the water reservoir. During cooler weather, the output air from the evaporative cooler is supplied to a series of ducts and is used to cool the interior of a structure such as a home. When the outside ambient temperature and/or humidity levels exceeds the capabilities of the evaporative cooler for cooling the interior of the structure to the desired temperature, the output air from the evaporative cooler is re-directed to the attic space of the structure and the refrigerated air from the refrigerated air system is used to cool the interior of the structure. By using the output air from the evaporative cooler to cool the attic space, the overall cooling load on the refrigerated air system is reduced. In addition, the use of the water from the reservoir to condense the refrigerant vapors will enable the system to achieve even greater efficiency.

24 Claims, 4 Drawing Sheets

METHOD AND APPARATUS FOR COOLING AIR AND WATER

RELATED APPLICATION

This application is a continuation-in-part of the earlier patent application by Leo B. Conner also entitled "METHOD AND APPARATUS FOR COOLING AIR AND WATER," Ser. No. 09/064,405, filed Apr. 22, 1998, which is a division of a patent issued to Leo B. Conner also entitled "METHOD AND APPARATUS FOR COOLING AIR AND WATER." Ser. No 08/924,727, U.S. Pat. No. 5,778,696, filed Sep. 5, 1997, each of which is incorporated herein by reference.

BACKGROUND OF THE INVENTION

1. Technical Field

The present invention relates to changing the ambient air temperature inside a structure and, more specifically, to a cooling method and apparatus which provides a simple, yet very energy-efficient, means of cooling the interior of a structure and the water in a water storage unit.

2. Background Art

Human beings are known for their ability to adapt to their environment or, to adapt their environment to them. One example of this quality is the continued expansion of human populations into areas previously deemed inhospitable to human life. Desert communities such as Phoenix, Ariz. and Las Vegas. Nev. are two well-known and rapidly growing areas which support burgeoning populations. In order to survive in these hot, desert climates, most structures designed for human occupation are provided with one or more systems for cooling the air inside the structure. Some of the various types of systems used to cool the air inside a structure are typically rated by using a system which assigns a Seasonal Energy Efficiency Ratio (SEER) rating or number to the system. A higher SEER rating indicates a more efficient system when compared with a system having a lower SEER rating.

One popular method of cooling the air inside a structure that has been adopted in many hot climates is the evaporative cooler. Evaporative coolers use a simple combination of a water pump, absorbent cooling pads, and a fan to provide cool air. Using basic principles of gravity and evaporation, air is cooled by forcing it through the evaporative cooler. Water is pumped into water-retaining pads which line the interior surface of the evaporative cooler and the outside air is drawn into the evaporative cooler by a large blower fan. By drawing the outside air through the water-soaked cooling pads, heat is transferred from the air to the water as water evaporation (heat of vaporization) occurs and the cooled air is blown into the structure, thereby cooling the interior of the structure.

While generally effective, evaporative coolers have certain well-known limitations. For example, as the outside air temperature increases, the evaporation process cannot sufficiently lower the temperature of the air in a structure to provide an acceptable temperature for human occupation. The evaporation rate, however, will continue to increase as the temperature increases. In addition, in very humid climates, evaporative coolers can be ineffective for cooling occupied structures at even relatively low ambient air temperatures due to the high amount of water vapor in the air. Once the air is saturated with water vapor, no additional cooling can take place.

To overcome the limitations associated with evaporative coolers, people living in many desert climates have turned to refrigerated air-conditioning systems to cool the air inside a structure. Instead of using the principles of evaporation, traditional refrigerated air-conditioning systems use the properties of refrigerant gases such as freon to cool the temperature of the air.

While very effective, refrigerated air-conditioning systems suffer from several undesirable characteristics. Foremost, these systems are relatively expensive to operate when compared to the nominal operational costs associated with most evaporative coolers. During the hottest part of the summer in more severe desert climates, the cooling costs associated with supplying electricity for a refrigerated air-conditioning system for even modest-sized homes can become exorbitant. Secondly, the compressors, fans, and motors used in typical residential air-conditioning systems are very loud and can contribute to a high level of ambient noise in some residential areas. In addition, the size and shape of the various components of the refrigerated air-conditioning system makes them somewhat unsightly next to a residence. Finally, the continued growth in the use of air-conditioning systems requires an ever-increasing expenditure of precious resources to generate the electricity necessary to operate the systems.

In some areas of the country, evaporative coolers and refrigerated air conditioning systems are both used, during different parts of the season, to cool the air inside a structure. In a typical scenario, an evaporative cooler may be used to reduce the ambient air temperature inside a structure during the relatively cooler and drier spring and early summer months (i.e., April, May, and June). Then, once the outside ambient air temperature and/or humidity has exceeded the capabilities of the evaporative cooler, typically in July, August, and possibly September, the evaporative cooler is switched off and the refrigerated air-conditioning system is used to reduce the ambient air temperature. Towards the end of the summer months as the fall season arrives, temperatures and humidity levels drop, and the evaporative cooler may once again be adequate to provide the desired cooling effect. While the use of both systems is more efficient than either system alone, these hybrid systems still suffer from the deficiencies associated with the respective component systems described above.

What is needed, therefore, is an apparatus and method for more efficiently cooling the interior of structures, particularly in hot desert climates where refrigeration is the primary method of cooling, while simultaneously decreasing the overall consumption of electric power. Without developing more efficient methods for providing cool air in hot desert climates, operating expenses borne by consumers for refrigerated air-conditioning systems will continue to rise and our earth's natural resources will continue to be diminished at an overly excessive rate.

DISCLOSURE OF INVENTION

A preferred embodiment of the present invention utilizes a swimming pool, the swimming pool water pump, an evaporative cooler, and a refrigerated air-conditioning system with a water-cooled condenser to provide a more energy-efficient means (SEER values up to 24 or more, including the evaporative cooler power consumption) for cooling a house, an office, a retail store, or other enclosed space. In addition, by selectively using the evaporative cooler to cool the interior of the attic space in a structure, the attic space acts as a buffer zone between the outside hot air and the sun-heated roof surfaces and the area inside the structure which is to be cooled. The introduction of the cooled output air from the evaporative cooler into the attic space significantly reduces the temperature differential between the air inside the dwelling portion of the structure and the ambient air temperature in the attic space. This, in turn, reduces the cooling load on the refrigerated air-conditioning system, that is used to cool the dwelling space inside the structure. The combination of the two cooling systems, operating in tandem to control the air temperature inside the structure, is more efficient than either system operating independently. This system will reduce the overall operating costs and energy consumption required to cool the interior space of a given structure by as much as 50%.

Additionally, since water-cooled condensers are more energy-efficient than the typical air-cooled condenser coils used in most residential and other small air-conditioning systems, the use of a water-cooled condenser in conjunction with the present invention further reduces operating costs. A refrigerated air-conditioning system utilizing a preferred embodiment of the present invention utilizes smaller components and is less obtrusive, visually and audibly, than a more conventional cooling system. Finally, in a preferred embodiment of the present invention, a swimming pool or other water storage source, such as the water reservoir of the evaporative cooler, is used to provide water for the evaporative cooler and for the water-cooled condenser as an integral part of the air-cooling system. Depending upon operating parameters, it may be desirable to include a mechanism or method for controlling the hardness of water supplied from the water storage source to the water-cooled condenser. A purge-type of mechanism that removes a portion of high-hardness water is preferred. Such a mechanism may include a conductivity sensor positioned to contact water supplied to the condenser, a hardness monitor linked to the sensor, and control valve triggered to open by the hardness monitor.

Numerous other advantages and features of the present invention will become readily apparent from the following detailed description of the invention, the drawings and the appended claims.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

The preferred embodiments of the present invention provide an energy-efficient means of cooling ambient air temperature. Various preferred embodiments of the present invention can be readily adapted to provide air-cooling capabilities for homes, offices, and other structures designed for human occupation or for storing temperature sensitive items such as food and other perishables. In addition, other preferred embodiments may be used to cool the ambient air temperature in other storage facilities and may also be used in conjunction with more traditional air-cooling systems to provide higher efficiencies and reduced operating costs.

DETAILED DESCRIPTION

In accordance with a preferred embodiment of the present invention, an air cooling system uses a combination of a swimming pool, a swimming pool pump, an evaporative cooler, and a refrigerated air-conditioning system to provide a more energy efficient means for cooling a house, an office, a retail store, or other structure. A secondary benefit of installing a preferred embodiment of the present invention is the general cooling effect provided for the water in the swimming pool.

The evaporative cooler can be used to cool either the attic space or the living spaces of a structure, as desired. During the evening and night hours, the output air from the evaporative cooler can be used to directly cool the living spaces of a home or other structure. Then, in the early morning hours, the cool air provided by evaporative cooler 120 can be redirected into the attic space of the home or structure. Once the cool, moist air from the evaporative cooler is no longer directed into the living spaces, the humidity in the living space will begin to drop as the outside temperature rises. This procedure minimizes the residual humidity level in the living spaces and can prevent the unnecessary accumulation of water vapor in the living spaces and the furniture, carpets, drapes, etc. contained in the living spaces. The cool air flowing through the attic space reduces the heat flow from the attic space to the living spaces, thereby slowing the normal temperature rise in the living spaces. Then, during the course of the day, as the outside temperature continues to increase and the temperature level in the living spaces becomes uncomfortable, the output from the evaporative cooler is once again directed into the living spaces to provide cooler air for reducing the ambient air temperature in the living spaces.

Figure 1:
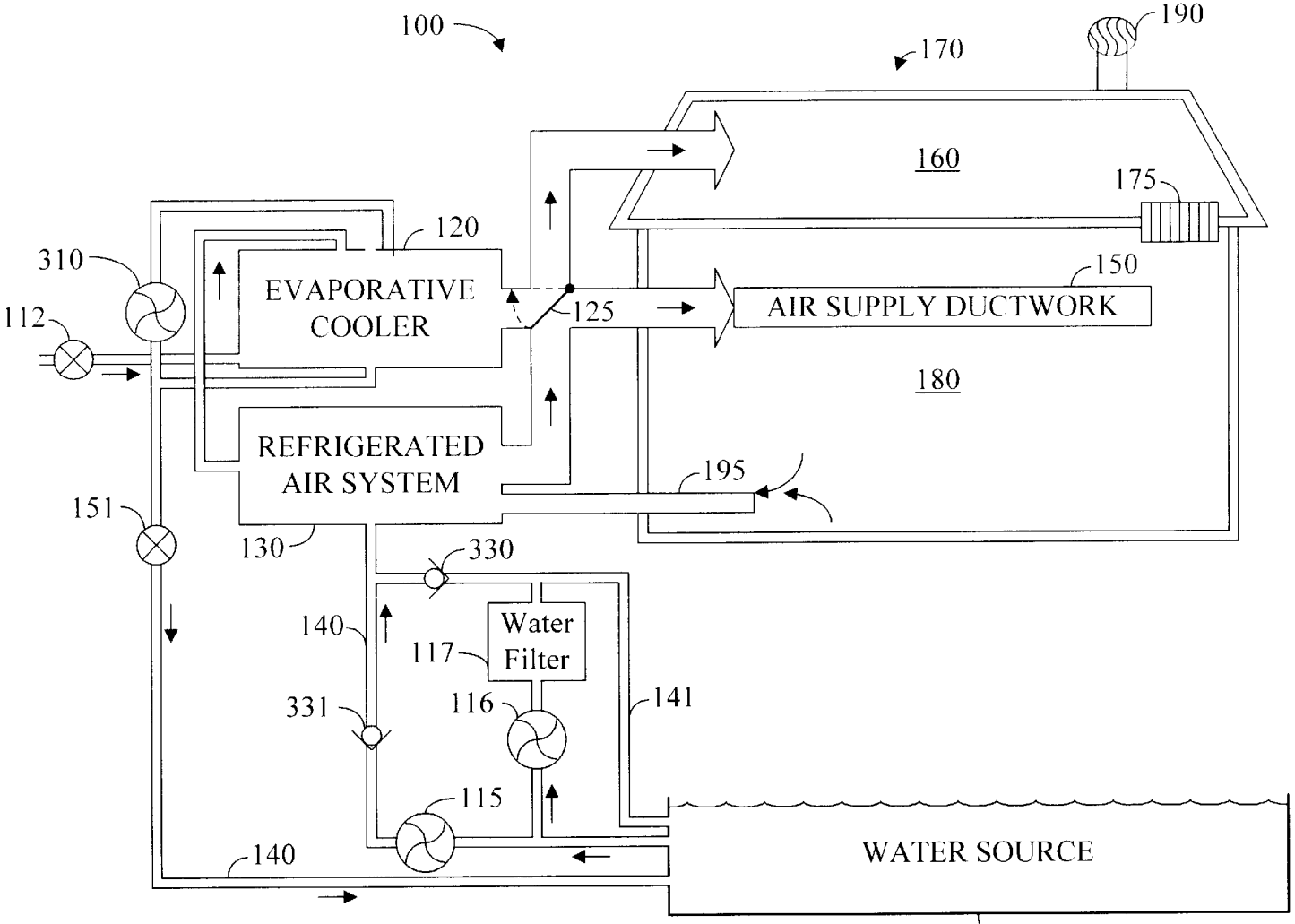
FIG. 1 is a block diagram of a air-cooling and water-cooling apparatus in accordance with a preferred embodiment of the present invention.

Referring now to FIG. 1, an air-cooling system 100 in accordance with a preferred embodiment of the present invention includes: a water source 110; a condenser pump 115; a pool pump 116; a water filter 117; an evaporative cooler 120; a bypass louver 125; a refrigerated air-conditioning system 130; water supply piping 140; filtered water return piping 141; a structure 170; an attic vent 190; return air ductwork 195; an evaporative cooler pump 310; alternate water source supply valve 112; valve 151; and check valves 330 and 331. Structure 170 includes: an air supply ductwork 150; an upduct 175; a living space 180; and an attic space 160.

Water source 110 is a water storage unit and may be any relatively large body or container of water suitable to supply the amount of water necessary for system 100 to operate as described herein. In the residential setting, water source 110 may be a swimming pool. In an industrial setting, water source 110 may be a water storage tank or a series of water storage tanks. In an agricultural setting, water source 110 may be a pond.

Bypass louver 125 is a pivotable airflow directional control mechanism. By moving bypass louver 125 from one position to another, the output airflow from evaporative cooler 120 may be directed into at least two different areas, namely attic space 160 and living space 180. Attic vent 190 is provided to allow hot air to escape from attic space 160 and return air ductwork 195 will supply input air for refrigerated air-conditioning system 130.

The exact size and number of components, horsepower rating of motors, length of tubing, and other factors relating to performance of system 100 as shown in FIG. 1 can be modified and adapted to suit the specifications of almost any given cooling requirement. For example, if more air flow is desired, the size of the fan or the fan speed in evaporative cooler 120 may be increased. If a larger volume of refrigerated air is required for a specific environment, the size of refrigerated air-conditioning, system 130 may be increased. For both aesthetic purposes and economic reasons, smaller, less obtrusive equipment should be selected wherever possible. In one preferred embodiment of the present invention, the main components for refrigerated air-conditioning system 130 are relatively small and may be placed out of sight behind evaporative cooler 120.

Wherever possible, the preferred embodiments of the present invention will include an arrangement where the cooling components (evaporative cooler and refrigerated air-conditioning system 130) are placed on the ground to reduce exposure to sun and the heat generated from roofing materials. This desired placement will also allow easy access to the components for repair and maintenance. In addition, when the components are placed on the ground, less noise from the equipment will be conducted through the building structure into the living spaces. If the cooling components are placed on the ground, it may be necessary to have a small pump (⅛ hp) to ensure circulation back to water source 110. However, as explained below, the requirement for a small pump can be obviated with additional system modifications.

The water supply portion of piping 140 is preferably PVC or ABS piping, sized as necessary to provide the appropriate flow rate from water source 110 to refrigerated air-conditioning system 130 and evaporative cooler 120. The portion of piping 140 used to return the water from evaporative cooler 120 to water source 110 is preferably standard ABS plastic drain piping. This piping may be sized from 2" diameter to 4" diameter, depending on the desired flow rate, "head pressure" (gravitational force and frictional flow losses associated with water systems) and other factors explained below. If the return path for the water to water source 110 has a sufficient negative gradient, the small pump mentioned above will not be necessary and may be eliminated. The pressure drop in filtered water return piping 141 usually supplies enough pressure to pump water through refrigerated air-conditioning system 130 and evaporative cooler 120.

Air Flow—Evaporative Cooler Mode

As shown in FIG. 1, in a preferred embodiment of the present invention, the air flow for structure 170 can be routed into structure 170 in several different ways in order to accommodate the most effective and efficient use of system 100 for cooling the temperature of the air contained in structure 170. Whenever ambient air conditions outside structure 170 permit, cool air for the interior of structure 170 will be supplied, as needed, from evaporative cooler 120 with evaporative cooler pump 310 recirculating the water for evaporative cooler 120. When system 100 of FIG. 1 is operated using only evaporative cooler 120, water can be supplied to system 100 through alternate water source supply valve 112 from a water source other than water source 110 (i.e., the city water system). In that case, refrigerated air-conditioning system 130 is shut off and valve 151 is closed. Valve 151 is closed to prevent water from evaporative cooler 120 from draining back into water source 110. Further, bypass louver 125 is positioned so that the air flowing out of evaporative cooler 120 is directed into air supply ductwork 150. Air supply ductwork 150 can be any type of air supply system used by those skilled in the art to deliver air into the various desired portions of structure 170.

In addition, in one preferred embodiment of the present invention, an upduct or vent 175 is supplied between living space 180 and attic space 160. Upduct 175 is preferably located on the side of structure 170 opposite evaporative cooler 120 to enhance air circulation. The pressure differential will enhance air flow and move the cool air more effectively through structure 170. In addition, it is important to note that a window or other opening may also serve as an upduct or vent for system 100. However, this will reduce the overall efficiency of system 100 because the cool air from living space 180 will not be vented through attic space 160, which is the most effective use of the cooled air from living space 180. Air in living space 180 will flow into attic space 160 through upduct 175 and be vented to the outside via attic vent 190, thereby cooling attic space 180 as the air passes through.

When using only evaporative cooler 120 to cool living space 180, the fan in evaporative cooler 120 may be operated 24 hours a day. Evaporative cooler pump 310 can also operate 24 hours a day. The monthly cost for using evaporative cooler 120 to cool a home with 2,000 sq/ft of living space 180 is approximately $10/month in the greater Phoenix area. Typically, louver 125 is positioned so that the output air from evaporative cooler 120 can be used to cool living space 180 during the evening and night hours. By using this approach, the air in living space 180 and attic space 160 will be cooled to a temperature of approximately 70° F. by morning.

In the morning, louver 125 can be repositioned and the output air from evaporative cooler 120 can be redirected into attic space 160. With no cooling provided for living space 180, the ambient air temperature in living space 180 will gradually begin to rise, even though attic space 160 is being cooled. During this time, the humidity in living space 180 will gradually diminish, making living space 180 less humid and allowing the carpets, furniture, and drapes in living space 180 to lose some absorbed moisture previously introduced by evaporative cooler 120.

When the ambient air temperature in living space 180 exceeds the desired level, louver 125 is repositioned so the output air from evaporative cooler 120 is redirected into living space 180. The ambient air temperature in living space 180 will gradually decrease to a more comfortable level. While using only evaporative cooler 120, neither refrigeration system 130 nor water source 110 are operated as part of system 100. Depending on the temperature and humidity conditions, evaporative cooler 120 may be used to cool only attic space 160, thereby maintaining a low humidity level in living space 180 yet still effectively reducing the heat transfer from attic space 160.

Air Flow—Refrigerated Air-Conditioning Mode

Whenever the ambient air temperature and/or humidity outside structure 170 exceeds the capability of evaporative cooler 120 to effectively cool the air for use in cooling living space 180, bypass louver 125 is positioned so that the air flowing from evaporative cooler 120 is directed into attic space 160. In this case, both evaporative cooler 120 and refrigerated air-conditioning system 130 are operational, and refrigerated air-conditioning system 130 will provide cool air for living space 180. The air flow from evaporative cooler 120 will reduce the ambient air temperature in attic space 160 from approximately 140° F. to approximately 100° F.

when the ambient air temperature outside structure 170 is approximately 110° F. To operate system 100 in this manner, evaporative cooler pump 310 is turned off, condenser pump 115 is turned on, and valve 151 is opened.

This significant decrease in ambient temperature for the air in attic space 160 will, in turn reduce the cooling load on refrigerated air-conditioning system 130, and thereby effectively reduce the operational expenses for system 100. In this mode, attic vent 190 vents hot air from attic space 160 to the outside. When using refrigerated air-conditioning system 130 to provide cool air for living space 180, the previously mentioned upduct or vent 175 is closed to prevent the cool air from being vented to attic space 160. Makeup or return air is supplied to refrigerated air-conditioning system 130 via return air ductwork 195.

Figure 2:
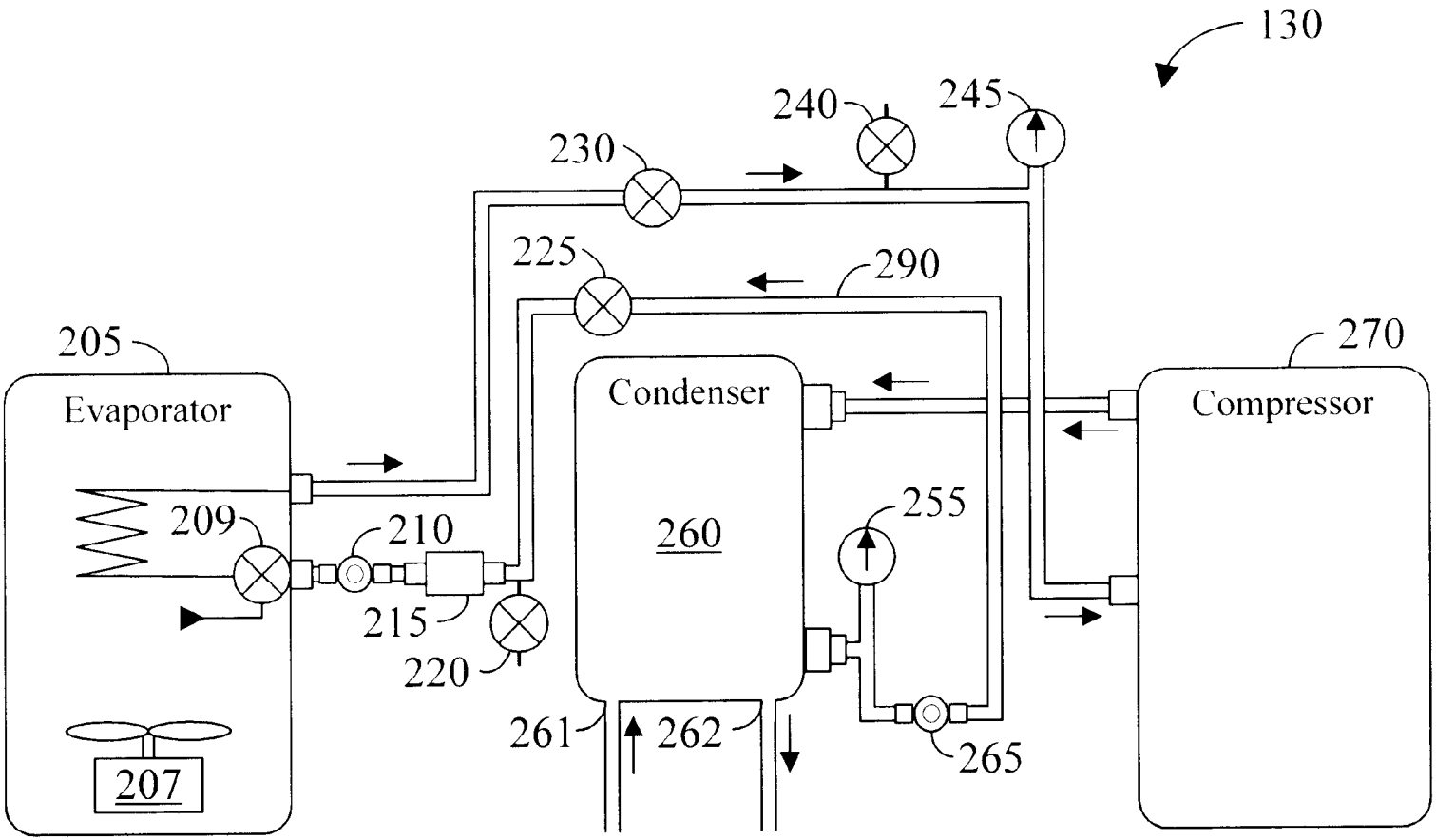
FIG. 2 is a schematic diagram of the main components of a refrigerated air-conditioning system in accordance with a preferred embodiment of the present invention.

Referring now to FIG. 2, a refrigerated air-conditioning system 130 in accordance with a preferred embodiment of the present invention includes: evaporator 205; evaporator fan motor 207; expansion valve 209; filter/drier 215; fill/evacuation valves 220 and 240; ball valves 225 and 230; gauges 245 and 255; condenser 260; compressor 270; sight glasses 210 and 265; and piping 290.

System 130 will typically utilize freon gas for refrigeration purposes but given the current environmental pressures on society to reduce or eliminate freon from refrigeration systems, it is contemplated that other gases which are known to those skilled in the art will be adapted for use with system 130 as well.

Condenser 260 and compressor 270 together are the "condensing unit" for the refrigerant in system 130. The condensing unit functions to condense the refrigerant vapor to a liquid. This is accomplished by compressing the refrigerant and cooling it until it liquefies. Compressor 270 increases the pressure of the refrigerant vapor and the cool water flowing through condenser 260 removes the heat from the refrigerant vapor to condense the refrigerant to a liquid.

Condenser 260 is a durable, high-efficiency, water-cooled condenser that provides heat transfer capabilities for system 130. Condenser 260 must present adequate surface area to remove the heat from the freon that flows through condenser 260. For the purposes of illustration to support system 130 as shown in FIG. 2, condenser 260 is approximately 4" by 4" by 18" with multiple stacked plates for heat transfer. It is desirable to provide a condenser 260 which causes a turbulent flow over the surface area of condenser 260 to maximize heat dissipation from the refrigerant vapor to the water flowing through condenser 260. Water is supplied to condenser 260 by condenser pump 115 (see FIG. 1). The temperature of the water entering condenser 260 at inlet opening 261 is approximately 85° F. (i.e., the temperature of water source 110 of FIG. 1) and the temperature at outlet opening 262 will be approximately 90° F. The outlet water is supplied to evaporative cooler 120.

One specific example of a water-cooled condenser suitable for use with refrigerated air-conditioning system 130 is condenser CB50-38 manufactured by Alfa-Laval in Sweden. While other types of condensers may be used, they are generally larger, less efficient, and/or more susceptible to damage. One specific example of a compressor suitable for use with refrigerated air-conditioning system 130 is the Copeland ZR28K1-PFV, rated at 3 tons.

Refrigerant Flow

Referring now to FIG. 2, the refrigerant flow for system 100 can be illustrated. Refrigerant vapor flows from evaporator 205 to compressor 270 and from compressor 270 to condenser 260. Evaporator 205 is typically mounted on a furnace unit (not shown) located within structure 170. Most furnace units include provisions to mount an evaporator such as evaporator 205 on the top of the furnace unit. The blowers of the furnace unit blow air from living space 180 through a heat exchanger to evaporate the refrigerant. The liquid refrigerant is boiled in the evaporator, thereby cooling the air, and the liquid refrigerant becomes a gas. The gaseous refrigerant is compressed by compressor 270 and is then routed to condenser 260 where the heat is removed by the cool water flowing through condenser 260. One heat exchanger suitable for use with system 100 is model TXC049A4HPA0 supplied by Trane. The exact location of evaporator 205 will be dictated, in large part, by the manufacturer's specification and installation directions. System 100 can accommodate any practical location for evaporator 205.

Sight glasses 210 and 265 are used to verify that the liquid refrigerant is free of vapor bubbles and is completely condensed as it enters evaporator 205. Ball valves 225 and 230 can be used to isolate the condensing unit from the evaporator unit during maintenance. Filter/drier 215 is used to remove any undesired water and sediment or particulates from the refrigerant as it flows through system 130. Fill/evacuation valves 220 and 240 can be used to add or remove refrigerant from system 130. Gauges 245 and 255 are used to monitor the pressure in system 130.

It should also be noted that the specific valves, gauges, and other details shown in FIG. 2 are not all necessary for all preferred embodiments of system 130. Many of these devices are included merely for operator convenience and to aid in troubleshooting system 130. In order to reduce initial installation costs, many of the valves, gauges, and sight glass elements shown may not be included in all preferred embodiments of refrigerated air-conditioning system 130.

Water Flow

Figure 3:
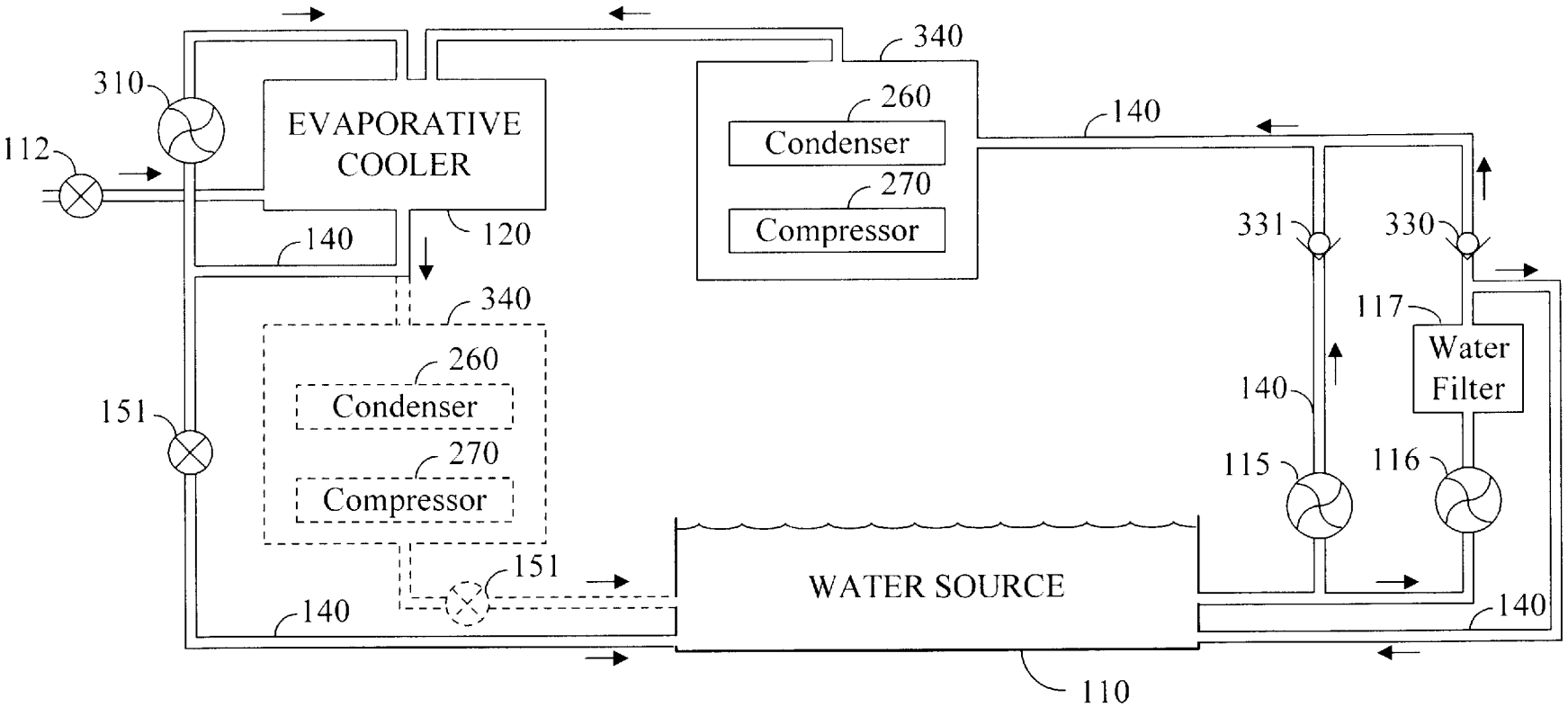
FIG. 3 is a schematic diagram showing the water flow of a system in accordance with a preferred embodiment of the present invention.

Referring now to FIGS. 1, 2, and 3, the water flow for system 100 of FIG. 1 is illustrated. When refrigerated air-conditioning system 130 is operational, evaporative cooler pump 310 is shut down, valve 151 is opened, alternate water source supply valve 112 is closed, and water from water source 110 is supplied by condenser pump 115 to condenser 260. Beginning with the water in water source 110, represented here as a residential swimming pool, the water temperature is nominally 85° F. as it exits water source 110 and is pumped through system 100 by condenser pump 115. In one preferred embodiment of system 100, condenser unit 340 (non-phantom view of FIG. 3) is located between water source 110 and the water inlet point for evaporative cooler 120. In this case, the water is supplied by condenser pump 115 to condenser 260.

After the water has flowed through condenser 260, the heat contained by the freon or other refrigerant has been transferred to the water. The temperature of the water as it exits condenser 260 at outlet 262 (as shown in FIG. 2) is approximately 90° F. The water is then supplied as inlet water to the top of evaporative cooler 120. As the water flows into evaporative cooler 120, it is gravity fed and then absorbed into a series of pads that form the walls of evaporative cooler 120. A portion of the water is then evaporated, thereby cooling the water and the air passing through evaporative cooler 120 to a temperature of approximately 80° F. Any unevaporated water is returned to water source 110. Thus, the pool water temperature drops as the 80 F. return water mixes with the 85° F. water stored in water source 110.

Alternatively, as shown in phantom view in FIG. 3, condenser unit 340 may be located between the water outlet point for evaporative cooler 120 and water source 110. If condenser 260 is placed in the location indicated by the phantom view for condenser unit 340, the water is routed into evaporative cooler 120 before being supplied to condenser 260. In that case, the outlet water from evaporative cooler 120 becomes the inlet water for the bottom of condenser 260 and the outlet water from condenser 260 is returned to water source 110.

Condenser pump 115 is sized according to the cooling needs of each specific application environment. For a typical residential structure of approximately 2,000 sq. ft., a 10 gallons per minute (GPM) pump is suitable. Given a required flow estimate of 3 GPM/ton of cooling required, a 10 GPM pump will allow for approximately 3⅓ tons of cooling to be provided by system 340. This level of cooling output is sufficient to cool a 2,000 sq. ft. home during the summer in a typical desert climate such as Phoenix, Ariz. Obviously, those skilled in the art will recognized that the size of condenser pump 115 and the associated GPM rating can be optimally selected to provide different levels of cooling for different environments.

In addition, based on the location of the various components of system 100, the pressure rating of condenser pump 115 may be increased or decreased as necessary to compensate for any head pressure developed in system 100. Finally, most swimming pools are equipped with a water filter pump 116 which is used to clean the water in the swimming pool by pumping it through water filter 117. This existing swimming pool water filter pump 116 can be utilized in conjunction with system 100 and may, in optimal circumstances, eliminate the need for condenser pump 115.

Whenever water filter pump 116 is running, it will discharge part of its filtered water back to evaporative cooler 120 and condenser 260. Condenser pump 115 will not be used at this time. Check valve 331 will prevent the water from flowing back through condenser pump 115. This operational mode will reduce the power consumption requirements for cooling structure 170, and will effectively increase the SEER number for system 100.

When compressor 270 is not running, the water flow from water filter pump 116 will continue to supply evaporative cooler 120 and evaporative cooler 120 will be used to cool both attic space 160 and the water contained in water source 110 as described earlier. Using this procedure, water filter pump 116 not only filters the water for water source 110, but also provides a contribution for the cooling of structure 170 and for reducing the temperature of water source 110 with no additional expense for electrical power consumption.

When water filter pump 116 is not running and refrigeration system 130 is used, condenser pump 115 will operate to circulate water for the cooling process. When neither water filter pump 116 nor condenser pump 115 are running, evaporative cooler pump 310 can recirculate water for evaporative cooler 120 and evaporative cooler 120 can continue to operate, thereby reducing the ambient temperature in attic space 160 and the heat load on structure 170. To operate in the fashion, valve 151 should be closed and alternate water source supply valve 112 should be opened. It is possible to leave both valves in the closed position and use the fan in evaporative cooler 120 to circulate ambient air in attic space 160 without supplying any water for cooling purposes. While not as effective, this option will still provide some measurable cooling effect and help to reduce the rate of temperature rise in attic space 160.

Check valve 330 prevents the water pumped by condenser pump 115 from flowing back through water filter pump 116 and the associated pipes to water source 110. There are many ways to isolate the pumps from each other besides using check valves 330 and 331. As long as water filter pump 116 is running, it will be cooling the water in water source 110. The colder the water that is supplied to condenser 260, the more efficient system 130 will be in removing heat from the refrigerant flowing through system 130. Once again, a benefit is provided both in cooler water for swimming in water source 110 and in reduced operational costs for system 100.

When cool air for the interior of structure 170 is to be supplied by evaporative cooler 120, evaporative cooler pump 310 is turned on, valve 151 is closed, and alternate water source supply valve 112 is opened. Whether the water for evaporative cooler 120 is supplied from evaporative cooler pump 310 or from condenser pump 115, it is preferably introduced into evaporative cooler 120 by a separate header to prevent cross coupling of the two water sources. Alternatively, a single header could be used if source isolation was insured by installing check valves in the appropriate supply lines. The water supply header is typically constructed from a perforated thin-walled PVC pipe that is placed around the top of the interior of evaporative cooler 120 to distribute the water to the pads inside evaporative cooler 120.

Check valve 331 is provided to prevent backflow into water source 110 when condenser pump 115 is shut off and to isolate condenser pump 115 from water filter pump 116. Check valve 331 also keeps condenser pump 115 primed for use if the condenser pump 115 is positioned above the surface of the water contained in water source 110. In addition, this will reduce the delay time in supplying water to condenser 260 by keeping pipes 140 full of water.

Alternative Embodiment

Figure 4:
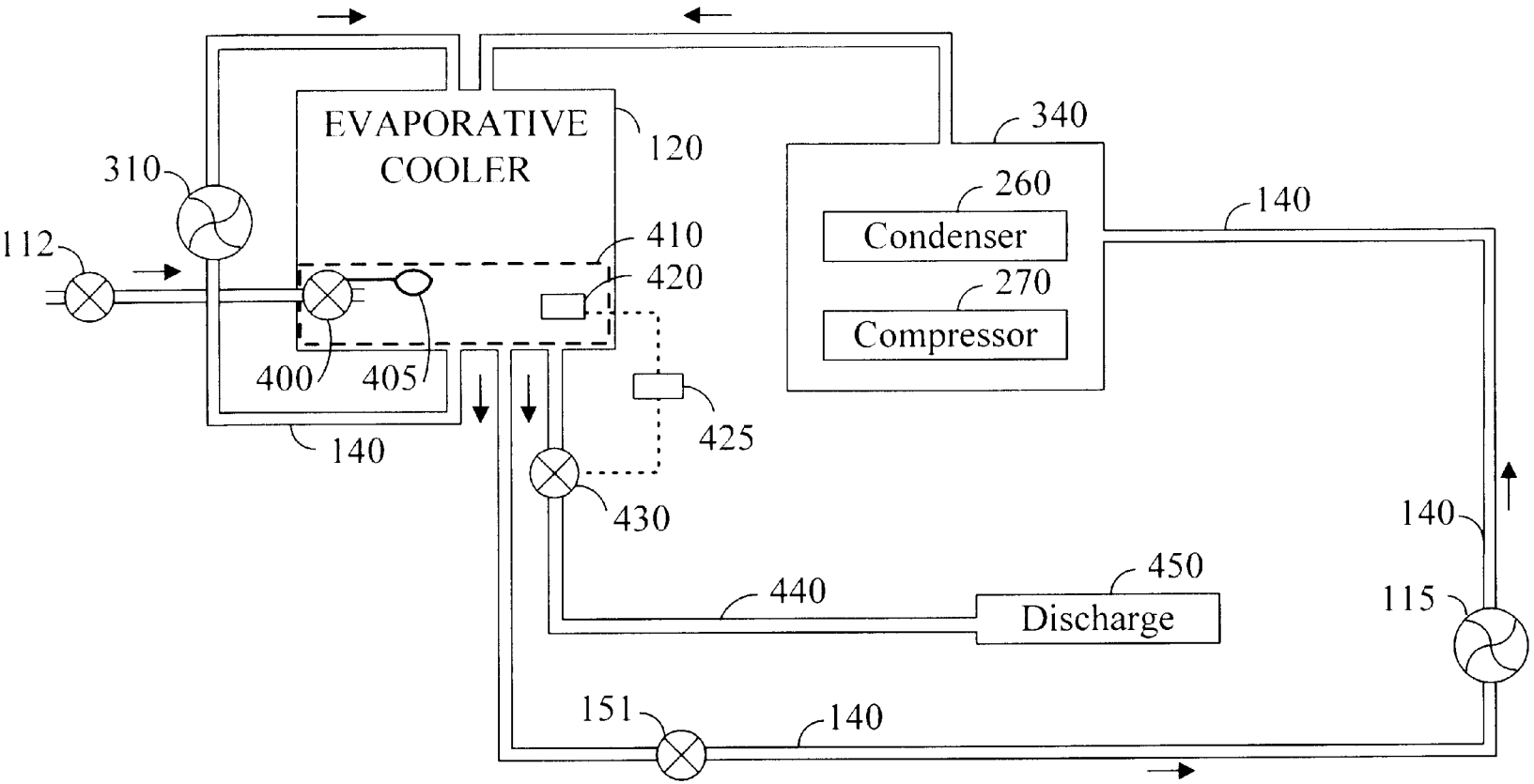
FIG. 4 is a schematic diagram showing the water flow of an alternative system in accordance with a preferred embodiment of the present invention.

Referring now to FIG. 4, an alternative preferred embodiment for the water flow of system 100 of FIG. 1 is shown. Such a water flow arrangement is compatible with all of the various arrangements for air flow and refrigerant flow discussed above. A key feature of the water flow arrangement shown in FIG. 4 is that water source 110 shown generically in FIGS. 1–3 is specified to be a water reservoir 410 of evaporative cooler 120. In general, evaporative coolers are fabricated with some sort of water reservoir designed to collect unevaporated water that drains from the cooling pads (not shown) within the evaporative cooler and to provide a source of water from which evaporative cooler pump 310 can recirculate water back to the top of the cooling pads of evaporative cooler 120. In this manner, an amount of water may be placed in water reservoir 410 and recirculated through evaporative cooler 120 to keep the cooling pads water-soaked and provide the desired cooling effect.

In many conventional self-contained evaporative coolers, a water reservoir 410 is created by providing a collection pan positioned beneath the cooling pads to receive unevaporated water that drains from the cooling pads. Typically, the collection pan is capable of holding several gallons of water and evaporative pump 310 rests in the pool of water established in water reservoir 410. Evaporative cooler pump 310 provides recirculating water to the cooling pads through tubing or piping connected to a water distributor at the top of the cooling pads as described above. Also, such collection pans often include a drain hole in the bottom for draining water reservoir 410 at the conclusion of the hot season. Such a drain hole provides a suitable location for connecting condenser unit 340 to water reservoir 410 using piping 140.

As the initial amount of water evaporates during operation of evaporative cooler 120, make-up water to replace the evaporated water may be added to water reservoir 410. Any method or mechanism known to those skilled in the art for adding make-up water may be used in the alternative preferred embodiment of FIG. 4. One common mechanism for adding make-up water is shown in FIG. 4 as a float-operated valve 400 in combination with a float 405. As a water level (not shown) in water reservoir 410 decreases, float 405 lowers in position until, at a preselected position, the mechanism of float-operated valve 400 allows the valve to open and resupply water reservoir 410 with water. The increasing water level then raises the position of float 405 sufficiently to cause the closing of float-operated valve 400. By this mechanism, the water level of water reservoir 410 can be maintained automatically within a desired range, thus, a source from which evaporative cooler pump 310 may recirculate water is always provided.

Frequently, an off-the-shelf evaporative cooler includes in a single unit the water reservoir 410, float-operated valve 400, float 405, and evaporative cooler pump 310, along with the necessary piping to accomplish the evaporative cooler 120 recirculation shown in FIG. 4. The scope of the present alternative preferred embodiment includes such a self-contained unit as well as arrangements in which the components discussed above are not provided in a single unit, although the self-contained type of unit is preferred an readily available.

It has been determined that a typical water reservoir 410 associated with an evaporative cooler 120 usually contains an amount of water suitable to supply the water needed for system 100 to operate as described herein. Accordingly, piping 140 is provided to couple evaporative cooler reservoir 410 to condenser unit 340 through condenser pump 115 as shown in FIG. 4. Once the water from water reservoir 410 passes through condenser unit 340, preferably the water returns to evaporative cooler 120, where the heat acquired from water-cooled condenser 260 may be dissipated using the evaporative process occurring in evaporative cooler 120. However, the water exiting condenser unit 340 may alternatively be discharged, although it is not preferred unless the discharged water may be put to some other use. Such other uses may include watering vegetation, supplying water to an industrial process, and other uses known to those skilled in the art.

As discussed above, when condenser pump 115 is in operation it is not necessary to simultaneously operate evaporative cooler pump 310. However, it may be operated simultaneously if needed depending on the flow rate provided by condenser pump 115 and the total flow rate needed for evaporative cooler 120. Additionally, the functions provided by evaporative cooler pump 310 may be provided by condenser pump 115 alone, allowing elimination of evaporative cooler pump 310. In the arrangement of FIG. 4 where water exiting condenser unit 340 is returned to evaporative cooler 120, the invention provides both the benefits and cooling air and cooling water. However, if all of the water from condenser unit 340 is discharged and no water is recirculated through evaporative cooler pump 310, then the invention only addresses the cooling of air and not the cooling of water. In such an arrangement, the water provided to evaporative cooler 120 through valve 112 must be routed directly to the cooling pads of evaporative cooler 120 rather than to water reservoir 410. The advantages of a FIG. 4 type of arrangement are that evaporatively cooled air may be provided to one location in a structure, such as an attic space, and air cooled by refrigeration may be provided to a different location within a structure, such as a living space or working space.

Although not preferred, it is also within the scope of the present invention that refrigerated air is supplied to a working or living space, but no evaporatively cooled air is supplied to another location within a structure. In such an arrangement the objective of coupling water cooled condenser 260 to water reservoir 410 is to provide a recirculating supply of cooled water to assist in generating refrigerated air. Such an arrangement may be desirable in regions that experience high humidity conditions. In high humidity conditions, only a relatively small amount of air cooling can be achieved by an evaporative cooler, thus diminishing a significant portion of the advantage of providing evaporatively cooled air to an attic space. However, an evaporative cooler 120 may be used to efficiently dissipate the heat collected from water cooled condenser 260 by the recirculating water. Thus, while the full benefits of all advantages of the present invention are best suited for regions of low humidity, such as hot, desert climates, some of the advantages of the present invention may nevertheless be obtained in other regions.

As indicated above, it is preferred that the water used in evaporative cooler 120 and in condensing unit 340 is recycled to evaporative cooler 120 to minimize the water demands of a system according to the present invention. Because some of the water is lost to evaporation in the evaporative process and the water is continuously recirculated, it is likely that the quality of the recirculating water will diminish gradually as the concentration increases of various chemical species found in residential and industrial water. Various salts of magnesium and calcium, such as calcium carbonate contribute to the increase of a condition known as water hardness. As hardness increases, the likelihood of mineral deposits accumulating on piping and equipment that contacts the water also increases. Such accumulations can require replacement and cleaning to prevent damage and maintain the level of performance, especially of heat exchange equipment such as condenser unit 340. Accordingly, measures are needed to prevent the accumulation of mineral deposits by maintaining hardness at a sufficiently low level.

The scope of the present invention includes any mechanism or method known to those skilled in the art for controlling the hardness of water supplied from water reservoir 410 to condenser unit 340. However, for the sake of simplicity and cost minimization, a purge-type of mechanism is preferred and is shown in FIG. 4. Such a mechanism includes a hardness sensor 420 positioned to contact water supplied to condenser 260 and a hardness monitor 425 linked to hardness sensor 420. Hardness sensor 420 transmits a signal to hardness monitor 425 that gives a quantified indication of hardness for the water. Hardness monitor 425 is, in turn, linked to a control valve 430. When hardness exceeds a maximum limit, hardness monitor 425 generates a signal to control valve 430 to open for a selected time, thus purging from the system a selected amount of high hardness water through discharge piping 440. Hardness sensor 420 may be a conductivity sensor or another type of sensor providing the indicated functions. Also, control valve 430 may be a solenoid valve or another type of valve providing the indicated functions. Further, discharge piping 440 may be any type of tubing or piping, including flexible hose, that allows proper discharge of purged high hardness water, including in some circumstances a typical garden water hose.

Selection of the amount of time to leave control valve 430 open may be preselected such that, given the flow rate of water through discharge piping 440 to discharge point 450, a known volume of water may be purged. Alternatively, hardness monitor 425 may be set such that control valve 430 remains open until the quantified indication of hardness produced by hardness sensor 420 reaches a minimum limit. Other control mechanisms are also conceivable. Also, the maximum limit is preferably 400 ppm hardness and the minimum limit is preferably 350 ppm, although each limit is dependent upon the particular environment in which the present invention is operating. The two preferred limits are suitable for a residential setting where residential water having a hardness of 200 ppm is provided as the make-up water. If the equipment used in such a setting is particularly resistant to mineral deposits, then the maximum limit may be higher than 400 ppm. Similarly, if equipment is particularly susceptible to influence by mineral deposits, then the minimum limit may be less than 350 ppm. Also, the difference between the maximum and minimum limit may be larger or smaller than 50 ppm, depending upon a need or a lack of a need to control hardness within a certain range.

Once control valve 430 opens and purging begins, the water level within water reservoir 410 will decrease, causing the position of float 405 to lower and open float-operated valve 400. The make-up water entering water reservoir 410 will then dilute the concentration of chemical species in the water to reduce hardness. A variety of positions within the water flow arrangement of FIG. 4 is conceivable for hardness sensor 420 and control valve 430. The primary concern is that water supplied to condenser 260 is kept within a preselected range of hardness, thus hardness sensor 420 can be placed at any location where it contacts water going to or coming from condenser 260. Similarly, the purge of water from the system may occur from water reservoir 410 as shown or from another suitable location within the arrangement shown in FIG. 4. Further, it is also conceivable that a different method or mechanism for adding makeup water to water reservoir 410 may be used in conjunction with the above described mechanism for controlling hardness.

Other possible mechanisms for controlling hardness include those that are adapted to selectively removing chemical species from water that cause hardness, such as reverse osmosis mechanisms, ion exchange mechanisms, filters, and other mechanisms known among those skilled in the art to combat hardness. Additionally, mechanisms may also be used that add selected amounts of one or more chemical agents that are adapted to counteracting the effects of water hardness rather than physically removing chemical species from the water. It is an advantage of the preferred purging mechanism for controlling hardness that little upkeep and maintenance is required after a one-time purchase and installation cost little. Also, the water purged through discharge piping 440 to discharge point 450 may be used as a beneficial source of water for some other purpose, such as watering vegetation or use in an industrial process, reducing the water demands for such other purposes. The alternative mechanisms for controlling hardness discussed herein are suitable for the present invention, but may be more costly and require more maintenance and upkeep than the preferred mechanism.

While the invention has been particularly shown and described with reference to exemplary embodiments thereof, it will be understood by those skilled in the art that changes in form and details may be made therein without departing from the spirit and scope of the invention. Accordingly, unless otherwise specified, any dimensions of the apparatus indicated in drawings or herein are given as an example of possible dimensions and not as a limitation. Similarly, unless otherwise specified, any sequence of method steps indicated herein is given as an example of a sequence and not as a limitation.

What is claimed is:

1. An apparatus for cooling the ambient air in a structure, the apparatus comprising:

an air supply ductwork system;

an evaporative cooler having a water reservoir;

a refrigerated air-conditioning system having a water-cooled condenser coupled to the evaporative cooler reservoir and a connection to the air supply ductwork, wherein at least a portion of output air is discharged through the air supply ductwork to a first location in the structure; and a mechanism for controlling hardness of the water supplied from the evaporative cooler reservoir to the water-cooled condenser.

2. The apparatus of claim 1, further comprising piping adapted to returning to the evaporative cooler at least a portion of any water supplied to the water-cooled condenser.

3. The apparatus of claim 1, wherein the evaporative cooler reservoir comprises a collection pan positioned to receive unevaporated water that drains from cooling pads within the evaporative cooler.

4. The apparatus of claim 1, wherein the evaporative cooler further comprises a connection to the air supply ductwork and at a least a portion of output air is discharged through the air supply ductwork to an attic space different from the first location.

5. The apparatus of claim 1, further comprising a multi-position airflow directional louver in the air supply ductwork for controlling the airflow within the air supply ductwork, wherein the evaporative cooler further comprises a connection to the air supply ductwork and at a least a portion of output air is discharged through the air supply ductwork to a second location in the structure.

6. The apparatus of claim 1, wherein the mechanism for controlling hardness comprises:

a hardness sensor positioned to contact water supplied to the water-cooled condenser;

a hardness monitor adapted to receive a quantified indication of hardness from the hardness sensor; and a control valve adapted to receive a signal from the hardness monitor to open, wherein a portion of water may be purged from the apparatus when in operation.

7. The apparatus of claim 6, wherein the hardness sensor comprises a conductivity sensor.

8. An apparatus for cooling the ambient air in a structure, the apparatus comprising:

an air supply ductwork system;

an evaporative cooler having a water reservoir and a connection to the air supply ductwork, wherein at least a portion of output air is discharged through the air supply ductwork to a first location in the structure;

a refrigerated air-conditioning system having a water-cooled condenser coupled to the evaporative cooler reservoir and a connection to the air supply ductwork, wherein at least a portion of output air is discharged through the air supply ductwork to a second location in the structure.

9. The apparatus of claim 8, further comprising a mechanism for controlling hardness of water supplied from the evaporative cooler reservoir to the water-cooled condenser.

10. The apparatus of claim 8, further comprising piping adapted to returning to the evaporative cooler at least a portion of any water supplied to the water-cooled condenser.

11. The apparatus of claim 8, wherein the evaporative cooler reservoir comprises a collection pan positioned to receive unevaporated water that drains from cooling pads within the evaporative cooler.

12. The apparatus of claim 8, wherein the second location in the structure comprises an attic space.

13. The apparatus of claim 8, further comprising a multi-position airflow directional louver in the air supply ductwork for controlling the airflow within the air supply ductwork.

14. The apparatus of claim 9, wherein the mechanism for controlling hardness comprises:

a hardness sensor positioned to contact water supplied to the water-cooled condenser;

a hardness monitor adapted to receive a quantified indication of hardness from the hardness sensor; and a control valve adapted to receive a signal from the hardness monitor to open, wherein a portion of water may be purged from the apparatus when in operation.

15. The apparatus of claim 14, wherein the hardness sensor comprises a conductivity sensor.

16. A method for cooling the ambient air in a structure, the method comprising the steps of:

supplying water from a water reservoir of an evaporative cooler to a water-cooled condenser of a refrigerated air-conditioning system;

supplying output air from the refrigerated air-conditioning system through an air supply duct to a first location in the structure; and controlling hardness of the water supplied from the evaporative cooler reservoir to the water-cooled condenser.

17. The method of claim 16, further comprising the step of returning to the evaporative cooler at least a portion of any water supplied to the water-cooled condenser.

18. The method of claim 16, wherein the step of controlling hardness comprises the steps of:

obtaining a quantified indication of the hardness of water supplied to the water-cooled condenser;

comparing the quantified indication to a maximum limit;

purging a portion of water upon exceeding the maximum limit; and replacing the purged water with water exhibiting a lower indication of hardness.

19. The method of claim 16, further comprising the step of supplying output air from the evaporative cooler through an air supply duct to an attic space different from the first location.

20. A method for cooling the ambient air in a structure, the method comprising the steps of:

supplying water from a water reservoir of an evaporative cooler to a water-cooled condenser of a refrigerated air-conditioning system;

supplying output air from the refrigerated air-conditioning system through an air supply duct to a first location in the structure; and supplying output air from the evaporative cooler through an air supply duct to a second location in the structure.

21. The method of claim 20, further comprising the step of controlling hardness of the water supplied from the evaporative cooler reservoir to the water-cooled condenser.

22. The method of claim 20, further comprising the step of returning to the evaporative cooler at least a portion of any water supplied to the water-cooled condenser.

23. The method of claim 21, wherein the step of controlling hardness comprises:

obtaining a quantified indication of the hardness of water supplied to the water-cooled condenser;

comparing the quantified indication to a maximum limit;

purging a portion of water upon exceeding the maximum limit; and replacing the purged water with water exhibiting a lower indication of hardness.

24. The method of claim 20, wherein the second location in the structure comprises an attic space.

* * * * *